US007628229B2

(12) United States Patent
Wood et al.

(10) Patent No.: US 7,628,229 B2
(45) Date of Patent: Dec. 8, 2009

(54) MOBILE DRILLING RIG WITH REPLACEABLE DOLLY

(75) Inventors: Thomas D. Wood, Calgary (CA); Richard D. Havinga, Okotoks (CA)

(73) Assignee: Xtreme Coil Drilling Corp., Calgara, Alberta (CA)

( * ) Notice: Subject to any disclaimer, the term of this patent is extended or adjusted under 35 U.S.C. 154(b) by 308 days.

(21) Appl. No.: 11/375,928

(22) Filed: Mar. 15, 2006

(65) Prior Publication Data

US 2007/0215359 A1 Sep. 20, 2007

(51) Int. Cl.
*E21B 19/08* (2006.01)

(52) U.S. Cl. ..... 175/203; 175/202; 175/89

(58) Field of Classification Search ..... 175/203, 175/202, 89

See application file for complete search history.

(56) References Cited

U.S. PATENT DOCUMENTS 6,371,505 B1 4/2002 Turner, II
6,767,172 B2 7/2004 French et al.
6,973,979 B2 * 12/2005 Carriere et al. ..... 175/203
7,308,953 B2 * 12/2007 Barnes ..... 175/203
2004/0211598 A1 10/2004 Palidis
2004/0240973 A1 12/2004 Andrews et al.
2005/0193645 A1 9/2005 Barnes
2005/0194189 A1 9/2005 Barnes

* cited by examiner

*Primary Examiner*—Jennifer H Gay
*Assistant Examiner*—Brad Harcourt
(74) *Attorney, Agent, or Firm*—Browning Bushman P.C.

(57) ABSTRACT

Mobile drilling rig 10 includes a carrier frame 14 and a mast 12 supported on the frame. A top drive 16 is supported on the mast when in an operative position, and a coil tubing injector 20 is supported on the mast when in an operative position. A first dolly assembly 22 and a second dolly assembly 60 are provided each for supporting a portion of the carrier frame, and include a first plurality of wheels on a first plurality of axles. Each dolly assembly is adaptive for selective attachment to and detachment from the carrier frame, so that the dolly assemblies may be changed out for compliance with regulations and road conditions.

23 Claims, 6 Drawing Sheets

MOBILE DRILLING RIG WITH REPLACEABLE DOLLY

FIELD OF THE INVENTION

The present invention relates to the mobile rig including the carrier frame, a mast, a top drive, and a coil tubing injector. More particularly, the mobile drilling rig includes a first dolly and a second dolly, each for selective engagement with the carrier frame during transport.

BACKGROUND OF THE INVENTION

Various techniques have been devised in an attempt to maximize the benefit of a trailer. Trailers are, of course, widely used to transport goods, and in particular heavy equipment. U.S. Pat. No. 6,371,505 discloses a double gooseneck trailer for hauling large, heavy loads. U.S. Pa. No. 6,767,172 discloses a low loader trailer, and in particular a front loading flatbed trailer.

Unique problems are presented when transporting a drilling rig, and in particular a drilling rig of a type which includes a coil tubing injector for injecting coil tubing into the well, and a top drive unit for handling conventional threaded tubulars during other well operations. U.S. Publication 2005/0194189 discloses a mobile drilling rig which is fabricated in three sections for transport to and installation at a drilling site. Publication 2004/0240973 discloses a transportable oil rig which includes in one embodiment a mast dolly positioned near the rear of the trailer. The mast dolly includes a set of wheels and an adjustable height support framework to stabilize the dolly and keep it level. The assembly may be made up and disassembled at the well site. Publication 2005/0193645 discloses another mobile drilling rig comprising two substructure sections and a mast section which may be assembled at the well site. Publication 2004/0211598 discloses a drilling rig with a specialized positioning dolly and an adjustable fifth-wheel truck connection for transporting the mast to the drill site for assembly.

The disadvantages of the prior art are overcome by the present invention, an improved mobile drilling rig is hereinafter disclosed.

SUMMARY OF THE INVENTION

In one embodiment, a mobile drill comprises a carrier frame and a mast supported on the frame during transport. The mast is raised to an operative position over a well. A top drive is supported on the mast when in operative position and it is moveable along an axis of the mast. A coil tubing injector is supported on the mast when in the operative position for injecting coil tubing into the well. A first dolly assembly for supporting the carrier frame is provided, with the first dolly assembly comprising a first plurality of wheels on a first plurality of axles. The first dolly assembly is adapted for selectively attachment to and detachment from the carrier frame, and supports the carrier frame during transport. A second dolly assembly is provided for replacing the first dolly assembly. In many applications, the second dolly assembly will have a different plurality of wheels and/or a different plurality of axles than the first dolly assembly.

According to one embodiment, a method of transporting and operating a drilling rig comprises providing at least one carrier frame, and supporting a mast on the at least one carrier frame for raising to an operative position over a well. A top drive is supported on the mast when in operative position and is moveable along an axis of the mast. A coil tubing injector is supported on the mast when in operative position for injecting coil tubing into the well. A first dolly assembly including a first plurality of wheels and a first plurality of axles is provided for selective attachment to and detachment from the carrier frame, and a second dolly assembly with a second plurality of wheels and a second plurality of axles is also provided for selective attachment to and detachment from the carrier frame. According to the method, one of the first and second dolly assemblies is removed from engagement with the carrier frame and the other of the first and second dolly assemblies is connected with the carrier frame.

These further features and advantages of the present invention will become apparent from the following detailed description, wherein reference is made to the figures in the accompanying drawings.

DESCRIPTION OF THE ILLUSTRATED EMBODIMENTS

Figure 1:
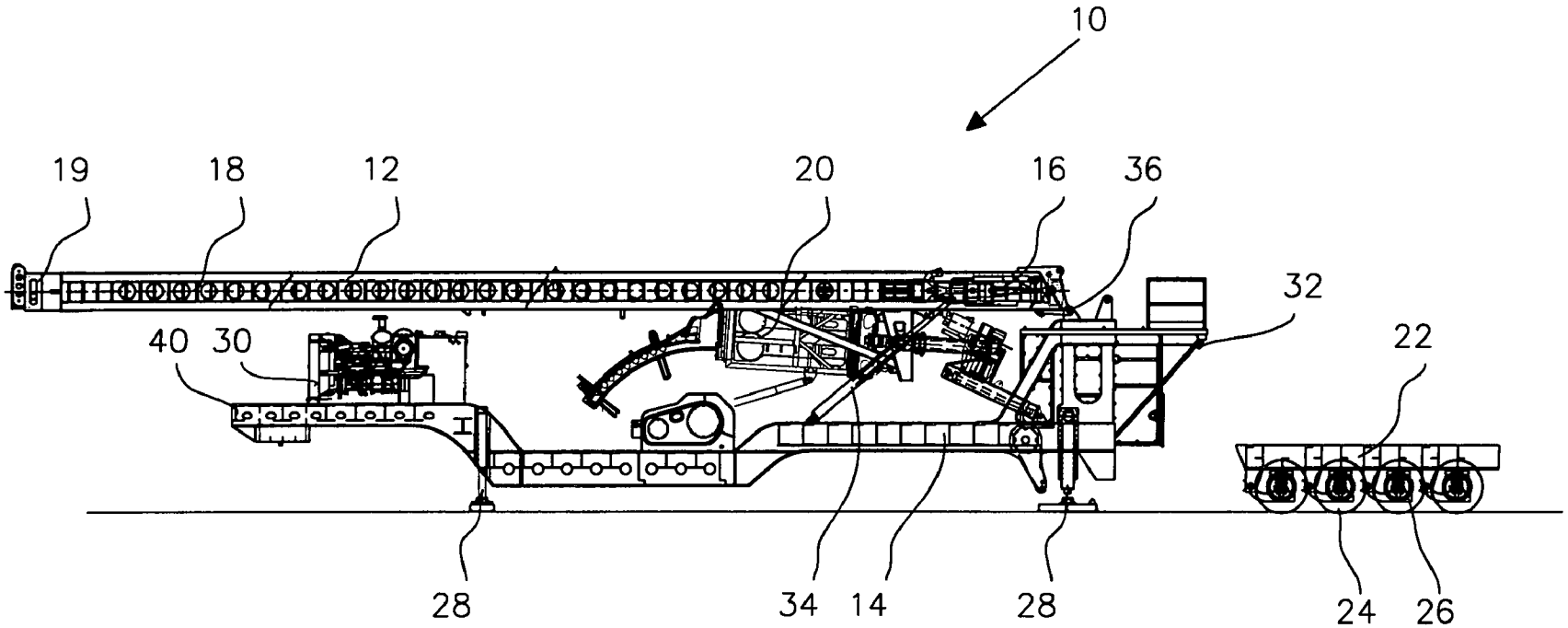
FIG. 1 is a side view of a suitable rig according to the present invention, with a dolly removed from the carrier frame, which is supported at the well site on a plurality of outriggers.

FIG. 1 illustrates in detail a mobile drilling rig 10 in the transport position, except that outriggers 28 are activated and the dolly removed from the carrier frame. The drilling rig includes a mast 12 which is pivotally supported on a carrier frame 14 and is in a substantially horizontal position during transport. Those skilled in the art appreciate that the mast 12 may be raised to a substantially vertical and operative position over the well during use of the mobile drilling rig. More particularly, the mobile drilling rig 10 is of the type which includes a top drive 16 supported on the mast when in an operative position and moveable along an axis 18 of the mast. The drilling rig also includes a coiled tubing injector 20 supported on the mast when in an operative position for injecting coil tubing into the well. Shown in FIG. 1, the top drive may be positioned axially below the coil tubing injector when the mast is raised, although the top drive 16 may be axially moved to a position above the coiled tubing injector 20 once the mast is raised. Those skilled in the art will appreciate that the top drive may be used for conducting oilfield operations with threaded tubular joints and tools, while the coiled tubing injector 20 is used for conducting coil tubing operations in the well.

FIG. 1 depicts a first dolly assembly 22 comprising a first plurality of wheels 24 and a first plurality of axles 26. The first dolly assembly is adapted for selective attachment to and detachment from the carrier frame 14, and is shown in FIG. 1 has been slid rearward and detached from the carrier frame. When detached, the plurality of outriggers 28 may be used for supporting and leveling the frame 14, which typically also supports power unit assembly 30 and a rear platform assembly 32. The plurality of hydraulic cylinders 34 may be provided for raising and lowering the mast 12 relative to the frame, and in a preferred embodiment the mast is pivotally connected to the frame at pivot 36.

In one embodiment, the top drive 16 and the coiled tubing injector 20 are each supported on the carrier frame 14 during transport. As shown in FIG. 1, the front portion of the carrier frame includes a gooseneck member 40 adapted for engagement with a tractor during transport. A rear portion of the carrier frame is supported by one of the dolly assemblies during transport. FIG. 1 further shows a crown block 19 supported on the mast when in an operative position, and a drum for paying out or pulling in a fastline, with the fastline engaging the crown block and moveably supporting a traveling block and/or the top drive on the mast.

Figure 2:
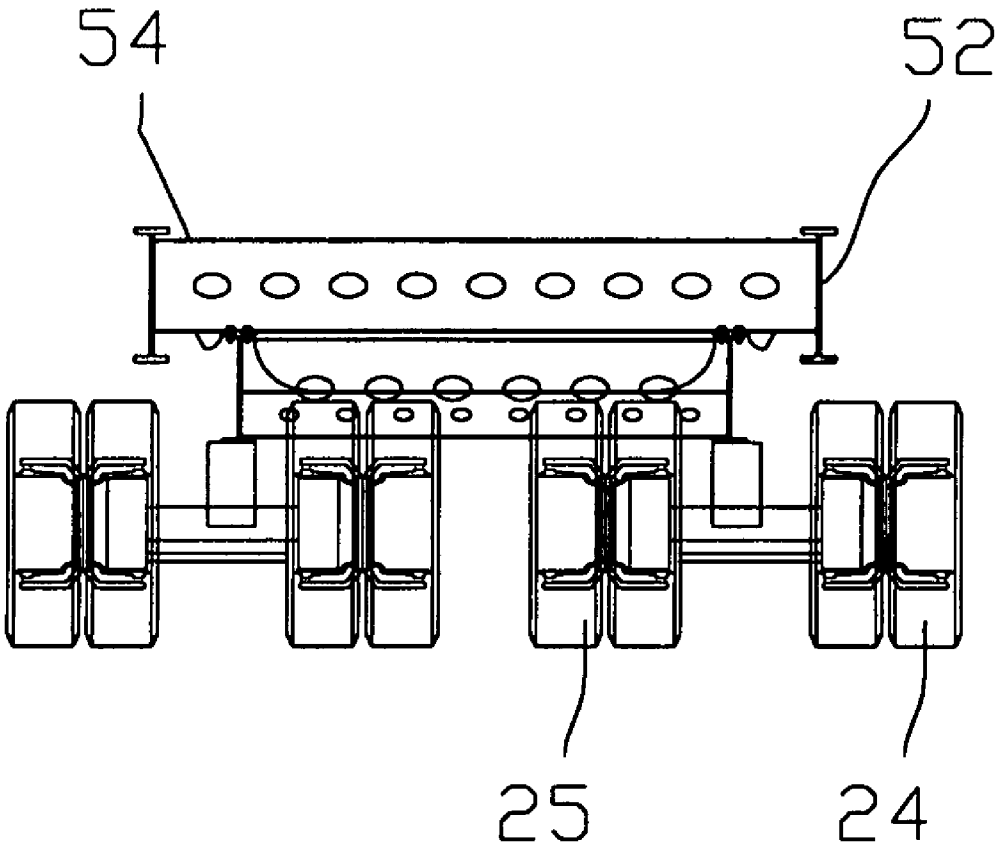
FIG. 2 is an end view of the dolly showing FIG. 1 attached to a frame member of the carrier frame.

Referring to FIGS. 1 and 2, the first dolly assembly 22 utilizes four axles on each side of the carrier frame, for a total of eight axles. Each axle in turn cooperates with a pair of outward wheels 24 and a pair of inward wheels 25, with the pair of inward wheels being spaced inward of an exterior frame support 52 and the perpendicular support 54.

Figures 3, 4:
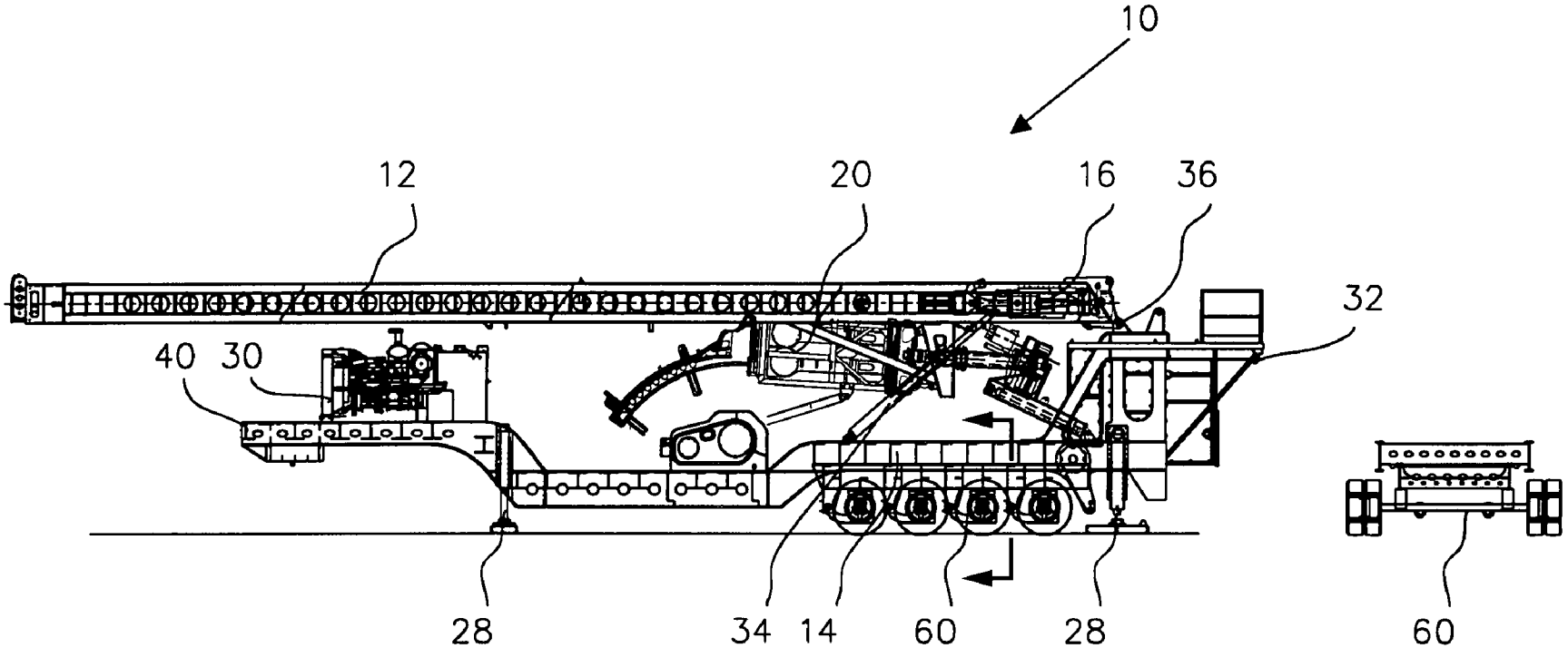
FIG. 3 depicts another dolly positioned for supporting the rear portion of the carrier frame.
FIG. 4 is an end view of the dolly shown in FIG. 3 attached to a frame member of the carrier frame.

As shown in FIGS. 3 and 4, substantially the same rig assembly is now supported on a second dolly assembly 60, which includes four axles with each axle having a pair of wheels at each end. The dolly assembly 60 may thus be slid under the frame 14 and attached to the frame. Although the load carried by the dolly has not changed, there are various reasons, including government regulations and load carrying regulations, why one of the dolly assemblies or, if desired, a third dolly assembly, may be used for transporting the rig to certain locations, and another dolly assembly then used to transport the same rig to other locations.

Figure 5:
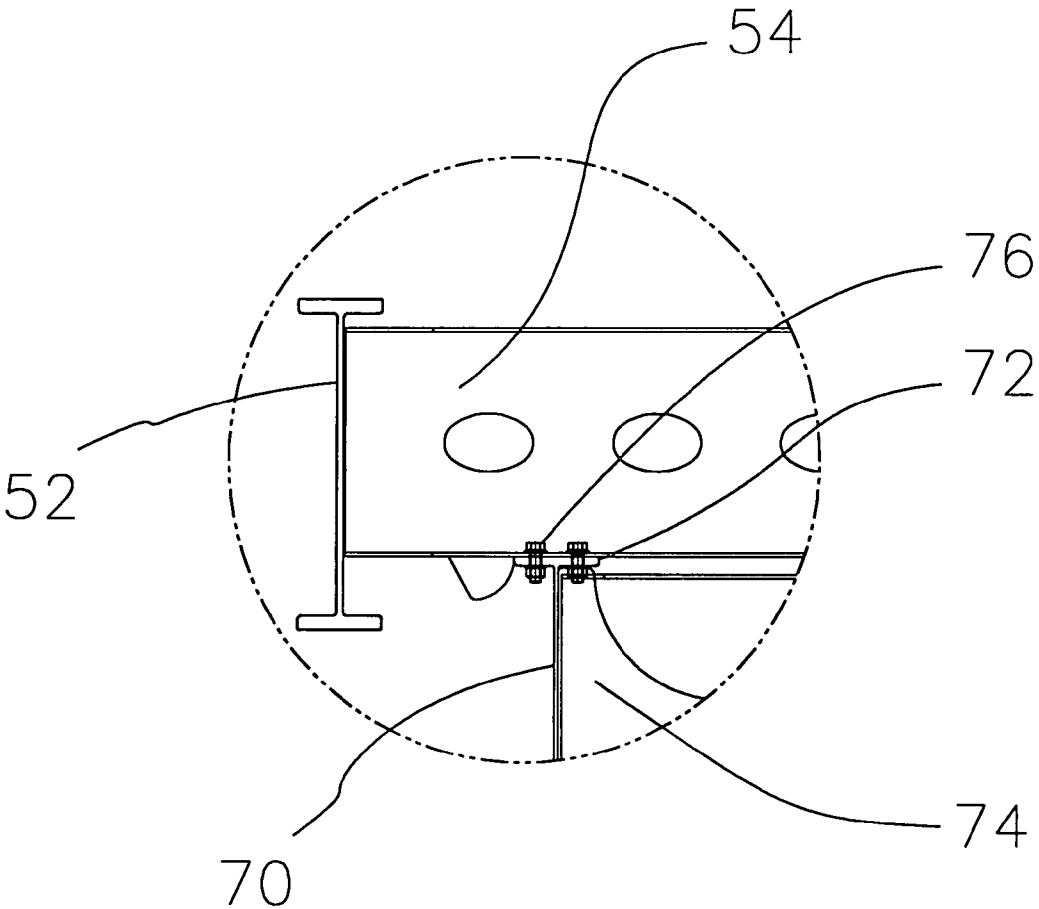
FIG. 5 shows in greater detail a suitable attachment mechanism for attaching and detaching the dolly from the carrier frame.

FIG. 5 shows in greater detail a suitable mechanism for selectively attaching and detaching a selected dolly assembly from the carrier frame. Each dolly assembly may include a left side and a right side I-beam 70 having upper flange 72 for engaging the beam 54 of the carrier frame. Dolly subframe 74 is positioned between the pair of I-beams 70, and conventional nut and bolt assembly 76 may be used for attaching both the I-beam and the dolly subframe 74 to the beam 54.

The embodiments discussed above include a carrier frame for supporting the mast, the top drive, and the coil tubing injector. The coil tubing reel, or optionally the coil tubing reel and the injector, may be provided on a second carrier frame structurally separate from the carrier frame which carries the mast and the top drive during transport.

Figure 6:
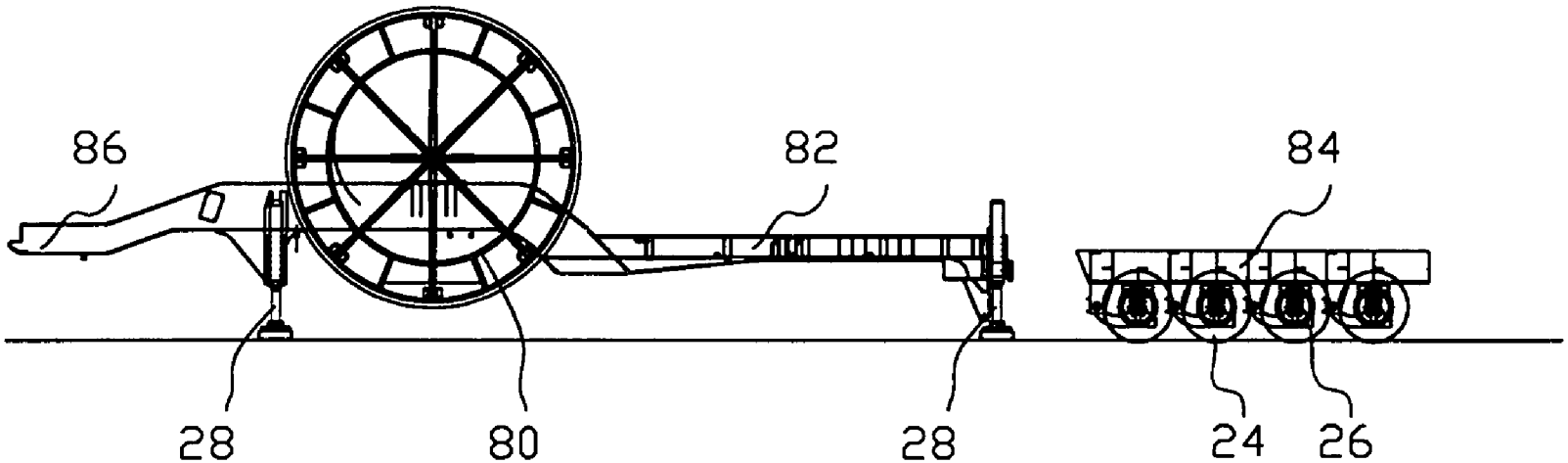
FIG. 6 shows an alternative rig with a replaceable dolly for a coiled tubing carrier.

Referring now to FIG. 6, a coil tubing reel 80 is shown on a coil tubing carrier frame 82, which also includes a plurality of outriggers 28. A dolly assembly 84 comprising a third plurality of wheels 24 and a third plurality of axles 26 may be selectively attached to and detached from the frame 82, as shown in FIG. 6, once the outriggers 22 have been lowered for supporting the frame 82 and the reel 80 supported thereon. Dolly 84 may thus be detached and slid away from the frame 82. The load carried by the frame 82 may be substantial in view of the weight of the coil carried on the reel 80. If desired, another dolly assembly with a different plurality of wheels and/or different plurality of axles may be slid under the frame to replace the dolly 84, thereby providing a fourth dolly assembly which has different load carrying characteristics and a different rating than the third dolly assembly. A front portion 86 of the frame 82 may be adapted for engagement with a tractor during transport, while the rear portion of the frame 82 is supported on one of the dolly assemblies during transport. The coil tubing carrier frame 82 and the reel 80 may thus be used in conjunction with the mast carrier frame as shown in FIGS. 1 and 3, and the dolly assembly for each frame may be changed out to another dolly assembly when the rig is transported from one location to a different location.

It should be understood that the dolly assembly 84 as shown in FIG. 6 may include a third plurality of wheels 24 and a third plurality of axles 26 which may be the same as one of the first and second dollies discussed above, although in most cases the third dolly will have a different plurality of wheels and/or a different plurality of axles than either the first or second dollies. Similarly, the fourth dolly assembly which may also be used with the coil tubing carrier frame 82 may have a different plurality of wheels and/or a different plurality of axles than the third dolly, such that each of the third and fourth dollies satisfies different governmental regulations and/or load carrying regulations. Those skilled in the art will appreciate that the coiled tubing reel alternatively may be carried on a frame which does not have an attachable and detachable dolly assembly, and similarly that the dolly assembly as shown in FIG. 6 with different attachable and detachable dollies may be used with a carrier frame for the rig in the top drive which does not have replaceable dolly assemblies.

Figure 7:
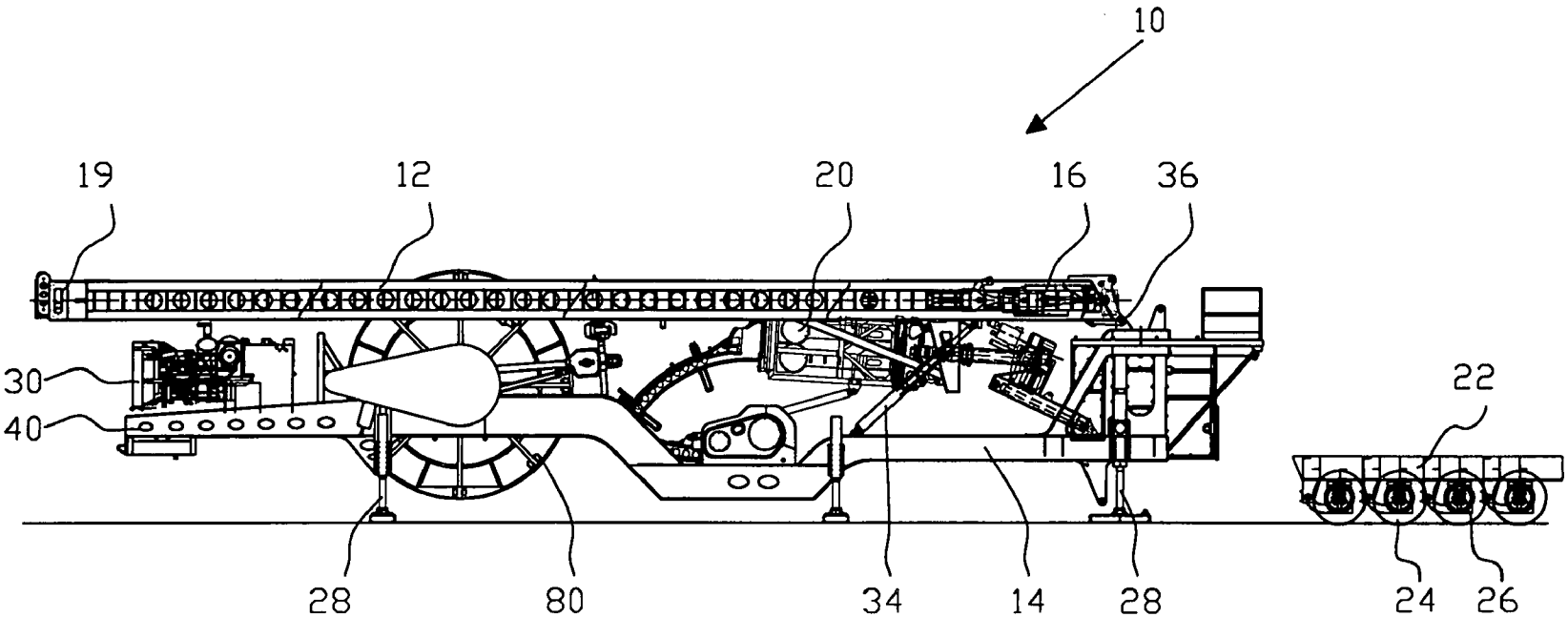
FIG. 7 is a side view of an alternate rig with a coiled tubing reel, an injector, a top drive and a mast all supported on a common carrier frame, with a dolly removed from the carrier frame.

FIG. 7 discloses another embodiment of a rig 10 wherein a single carrier frame 14 supports the mast, the top drive 16, coil tubing injector 20, and the coil tubing reel 80 thereon. FIG. 7 depicts the dolly assembly 22 removed from the frame 14, which is supported by the outriggers 28. The rig as shown in FIG. 7 is otherwise substantially similar to the rig as shown in FIGS. 1 and 3, with the primary difference being that the reel 80 is supported on the same frame as the mast 12.

For the illustrated embodiments, the dolly may be detached and slid rearward away from the frame or carrier. In other applications, the positioning of the outriggers may facilitate removal of one dolly and replacement with another dolly from the left side or the right side of the carrier.

For each of the embodiments disclosed herein, the carrier frame, or each of the carrier frames, if a separate carrier frame is provided for the coil tubing reel, operates to carry a substantially fixed load, i.e., the load comprises the equipment supported on and secured to the carrier frame. This is to be distinguished from a flat bed trailer which may be sized to receive a variable load skid mounted carrier frame supported on the flat bed trailer for transportation to another site. Such a flat bed trailer does not support a fixed load, since the load is not permanently secured to the flat bed trailer, and instead is placed on the flat bed trailer, latched to the trailer with chains or cables, transported to the site, and then detached from the flat bed trailer. A significant advantage of the embodiments disclosed herein compared to rigs which use a flat bed trailer relates to the substantial cost and difficulty associated with unloading and loading a rig from a flat bed trailer, and the desired ability of the carrier frame according to the present invention to be placed very low relative to the ground surface during transport, the ability to quickly set up the rig components for a drilling operation, a low center of gravity for the rig carrier frame when drilling, and the ability to quickly and easily move the rig to another location when the drilling operation is complete.

As disclosed herein, the first dolly differs from the second dolly in that at least one of the dollies has a different number of axles or a different position of the axles, or a different number of wheels on one or more of the axles, compared to the other dolly assembly. Thus one dolly assembly is better able to satisfy strict load regulations, while the other dolly assembly may be used in locations where the regulations are not as strict. In either case, the versatility of the rig is significantly improved because of the interchangeability of the dollies. The first dolly assembly may thus have a plurality of wheels which is the same or different than the second dolly assembly, and the first dolly assembly has a number or location of axles which are different than the second dolly assembly. In most cases, one dolly assembly will have a different number of wheels than the other dolly assembly, and will have a different number of axles than the other dolly assembly.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations, and modifications, including but not limited to those design alternatives specifically discussed herein, may be made in the practice of the invention without departing from its scope.

What is claimed is:

1. A mobile drilling rig, comprising:

a carrier frame adapted for selective attachment to one of a first dolly assembly and a second dolly assembly, the carrier frame having a rearward portion and an opposing forward portion for connecting to a powered tractor;

a mast pivotally connected in a lowered position to the rearward portion of the carrier frame during transport and raised to an operative position over a well;

a top drive supported on the mast when in an operative position and moveable along the mast;

a coil tubing injector supported on the mast when in an operative position for injecting coil tubing into the well;

the first dolly assembly supporting at least a portion of the carrier frame when attached thereto, the first dolly assembly comprising a first plurality of wheels on a first plurality of axles, the first dolly assembly adapted for selective attachment to and detachment from the rearward portion of the carrier frame; and the second dolly assembly supporting at least a portion of the frame when attached thereto, the second dolly assembly comprising a second plurality of wheels on a second plurality of axles, the first plurality of wheels on the first plurality of axels differing in at least one of number and spacing from the second plurality of wheels on the second plurality of axels, the second dolly assembly adapted for selective attachment to and detachment from the rearward portion of the carrier frame.

2. A mobile drilling rig as defined in claim 1, wherein the top drive and the coil tubing injector are supported on the carrier frame during transport.

3. A mobile drilling rig as defined in claim 2, further comprising:

a coil tubing reel supported on the carrier frame during transport.

4. A mobile drilling rig as defined in claim 1, wherein the first plurality of axles differs in at least one of number and spacing between wheels from the second plurality of axles.

5. A mobile drilling rig as defined in claim 1, further comprising:

a plurality of outriggers spaced about the carrier frame for engaging the ground surface to support the carrier frame.

6. A mobile drilling rig as defined in claim 1, further comprising:

at least one hydraulic cylinder supported on the carrier frame for raising and lowering the mast.

7. A mobile drilling rig as defined in claim 1, further comprising:

a crown block supported on the mast when in an operative position;

a drum for paying out and pulling in a fastline; and the fastline engaging the crown block and moveably supporting the top drive on the mast.

8. A mobile drilling rig as defined in claim 1, further comprising:

a coil tubing reel supported on a coil tubing carrier frame during transport, the coil tubing carrier frame being substantially separate from the carrier frame;

a third dolly assembly for supporting at least a portion of the coil tubing carrier frame, the third dolly assembly comprising a third plurality of wheels on a third plurality of axles, the third dolly assembly adapted for selective attachment to and detachment from the coil tubing carrier frame; and a fourth dolly assembly for supporting at least a portion of the coil tubing frame, the fourth dolly assembly comprising a fourth plurality of wheels on a fourth plurality of axles, the first plurality of wheels on the first plurality of axels differing in at least one of number and spacing from the second plurality of wheels on the second plurality of axels, the fourth dolly assembly adapted for selective attachment to and detachment from the coil tubing carrier frame.

9. A mobile drilling rig as defined in claim 8, wherein the third plurality of wheels differs from the fourth plurality of wheels in at least one of number and spacing, and the third plurality of axles differs from the fourth plurality of axles in at least one of number and spacing.

10. A mobile drilling rig, comprising:

a carrier frame adapted for selective attachment to one of a first dolly assembly and a second dolly assembly, the carrier frame having a rearward portion and an opposing forward portion for connecting to a powered tractor;

a mast pivotally connected in a lowered position to the rearward portion of the carrier frame and raised to an operative position over a well;

a top drive supported on the mast when in an operative position and moveable along the mast;

a coil tubing injector supported on the mast when in an operative position for injecting coil tubing into the well;

the first dolly assembly supporting at least a portion of the carrier frame when attached thereto, the first dolly assembly comprising a first plurality of wheels on a first plurality of axles, the first dolly assembly adapted for selective attachment to and detachment from the rearward portion of the carrier frame; and the second dolly assembly supporting at least a portion of the frame when attached thereto, the second dolly assembly comprising a second plurality of wheels on a second plurality of axles differing in at least one of number and spacing from the first plurality of wheels on the first plurality of axles, the second dolly assembly adapted for selective attachment to and detachment from the rearward portion of the carrier frame.

11. A mobile drilling rig as defined in claim 10, wherein the first plurality of axles differs from the second plurality of axles.

12. A mobile drilling rig as defined in claim 10, further comprising:

a coil tubing reel supported on a coil tubing carrier frame during transport, the coil tubing carrier frame being substantially separate from the carrier frame;

a third dolly assembly for supporting at least a portion of the coil tubing carrier frame, the third dolly assembly comprising a third plurality of wheels on a third plurality of axles, the third dolly assembly adapted for selective attachment to and detachment from the coil tubing carrier frame; and a fourth dolly assembly for supporting at least a portion of the coil tubing frame, the fourth dolly assembly comprising a fourth plurality of wheels on a fourth plurality of axles differing in at least one of number and spacing from the third plurality of wheels on the third plurality of axels, the fourth dolly assembly adapted for selective attachment to and detachment from the coil tubing carrier frame.

13. A mobile drilling rig as defined in claim 12, wherein the third plurality of wheels differs from the fourth plurality of wheels in one of at least number and spacing, and the third plurality of axles differs from the fourth plurality of axles in at least one of number and spacing.

14. A method of transporting and operating a drilling rig, comprising:

providing a carrier frame adapted for selective attachment to one of a first dolly assembly and a second dolly assembly, the carrier frame having a rearward portion and an opposing forward portion for connecting to a powered tractor;

pivotally supporting a mast on the rearward portion of the carrier frame for raising to an operative position over a well;

supporting a top drive on the mast when in an operative position and moveable along the mast;

supporting a coil tubing injector on the mast when in an operative position for injecting coil tubing into the well;

providing the first dolly assembly supporting at least a portion of the carrier frame when attached thereto, the first dolly assembly comprising a first plurality of wheels on a first plurality of axles, the first dolly assembly adapted for selective attachment to and detachment from the rearward portion of the carrier frame;

providing the second dolly assembly supporting at least a portion of the frame when attached thereto, the second dolly assembly comprising a second plurality of wheels on a second plurality of axles, the second dolly assembly adapted for selective attachment to and detachment from the rearward portion of the carrier frame, the first plurality of wheels on the first plurality of axels differing in at least one of number and spacing from the second plurality of wheels on the second plurality of axels; and removing one of the first and second dolly assemblies from engagement with the carrier frame and connecting the other of the first and second dolly assemblies with the carrier frame.

15. A method as defined in claim 14, wherein the first plurality of axles differs in at least one of number and spacing from the second plurality of axles.

16. A method as defined in claim 14, further comprising:

supporting a coil tubing reel on a coil tubing carrier frame during transport, the coil tubing carrier frame being substantially separate from the carrier frame;

supporting at least a portion of the coil tubing carrier frame on a third dolly assembly, the third dolly assembly comprising a third plurality of wheels on a third plurality of axles, the third dolly assembly adapted for selective attachment to and detachment from the coil tubing carrier frame; and supporting at least a portion of the coil tubing frame on a fourth dolly assembly, the fourth dolly assembly comprising a fourth plurality of wheels on a fourth plurality of axles differing in at least one of number and spacing from the third plurality of wheels on the third plurality of axels, the fourth dolly assembly adapted for selective attachment to and detachment from the coil tubing carrier frame.

17. A method as defined in claim 16, wherein the third plurality of wheels differs from the fourth plurality of wheels, and the third plurality of axles differs from the fourth plurality of axles.

18. A mobile coil tubing carrier frame, comprising:

a coil tubing reel supported on the coil tubing carrier frame during transport, the coil tubing carrier frame being structurally separate from a carrier frame for a drilling rig mast and having a rearward portion and an opposing forward portion for connecting to a powered tractor;

the coil tubing carrier adapted for selective attachment to one of one dolly assembly and another dolly assembly;

the one dolly assembly supporting at least a portion of the coil tubing carrier frame, the one dolly assembly comprising one plurality of wheels on one plurality of axles, the one dolly assembly adapted for selective attachment to and detachment from the rearward portion of the coil tubing carrier frame; and the another dolly assembly supporting at least a portion of a coil tubing carrier frame, the another dolly assembly comprising another plurality of wheels on another plurality of axles differing in at least one of number and spacing from the one plurality of wheels on the one plurality of axels, the another dolly assembly adapted for selective attachment into and detachment from the rearward portion of the coil tubing carrier frame.

19. A mobile coil tubing carrier frame as defined in claim 18, wherein the one plurality of axles differs in at least one of number and spacing from the another plurality of axles.

20. A mobile coil tubing carrier frame as defined in claim 18, wherein a front portion of the coil tubing carrier frame is adapted for engagement with a tractor during transport; and a rear portion of the coil tubing carrier frame is adapted for and supported by one of the one dolly assembly and the another dolly assembly.

21. A mobile coil tubing carrier frame as defined in claim 18, further comprising:

a plurality of outriggers spaced from the coil tubing carrier frame for engaging the ground surface to support the coil tubing carrier frame.

22. A mobile drilling rig, comprising:

a carrier frame adapted for selective attachment to one of a first dolly assembly and a second dolly assembly;

a mast supported on the carrier frame during transport and raised to an operative position over a well;

a top drive supported on the mast when in an operative position and moveable along the mast;

a coil tubing injector supported on the mast when in an operative position for injecting coil tubing into the well;

the first dolly assembly supporting at least a portion of the carrier frame when attached thereto, the first dolly assembly comprising a first plurality of wheels on a first plurality of axles, the first dolly assembly adapted for selective attachment to and detachment from the carrier frame; and the second dolly assembly supporting at least a portion of the frame when attached thereto, the second dolly assembly comprising a second plurality of wheels on a second plurality of axles, the first plurality of wheels on the first plurality of axels differing in at least one of number and spacing from the second plurality of wheels on the second plurality of axels, the second dolly assembly adapted for selective attachment to and detachment from the carrier frame;

a coil tubing reel supported on a coil tubing carrier frame during transport, the coil tubing carrier frame being substantially separate from the carrier frame;

a third dolly assembly for supporting at least a portion of the coil tubing carrier frame, the third dolly assembly comprising a third plurality of wheels on a third plurality of axles, the third dolly assembly adapted for selective attachment to and detachment from the coil tubing carrier frame; and a fourth dolly assembly for supporting at least a portion of the coil tubing frame, the fourth dolly assembly comprising a fourth plurality of wheels on a fourth plurality of axles, the first plurality of wheels on the first plurality of axels differing in at least one of number and spacing from the second plurality of wheels on the second plurality of axels, the fourth dolly assembly adapted for selective attachment to and detachment from the coil tubing carrier frame.

23. A mobile drilling rig as defined in claim 22, wherein the third plurality of wheels differs from the fourth plurality of wheels in at least one of number and spacing, and the third plurality of axles differs from the fourth plurality of axles in at least one of number and spacing.

* * * * *